US006580361B2

(12) United States Patent
Bucher

(10) Patent No.: US 6,580,361 B2
(45) Date of Patent: Jun. 17, 2003

(54) LOW VOLTAGE SPEAKER AND LIGHTING SYSTEM

(76) Inventor: Charles E. Bucher, 2114 Gold Manor Blvd., Valrico, FL (US) 33594

( * ) Notice: Subject to any disclaimer, the term of this patent is extended or adjusted under 35 U.S.C. 154(b) by 0 days.

(21) Appl. No.: 09/746,785

(22) Filed: Dec. 21, 2000

(65) Prior Publication Data

US 2002/0080011 A1 Jun. 27, 2002

(51) Int. Cl.[7] ..... G08B 27/00

(52) U.S. Cl. ..... 340/326; 340/693.2; 362/253; 362/20

(58) Field of Search ..... 340/326, 540, 340/552, 541, 565, 667, 517, 521, 522, 635, 600, 601, 641, 568.1, 657, 686.1, 693.2, 652; 361/54; 362/20, 152, 253

(56) References Cited

U.S. PATENT DOCUMENTS 4,899,388 A * 2/1990 Mlodzikowski ..... 381/77
5,726,629 A * 3/1998 Yu ..... 340/565
5,781,108 A * 7/1998 Jacob ..... 340/552
5,788,553 A * 8/1998 Shivers ..... 446/91

* cited by examiner

*Primary Examiner*—Benjamin C. Lee
(74) *Attorney, Agent, or Firm*—Holland & Knight LLP

(57) ABSTRACT

An integrated outdoor lighting and sound systems comprising a plurality of outdoor landscaping lighting units, a wiring cable interconnecting the plurality of outdoor landscaping lighting units, a source of low-voltage energy connected to said wiring cable and a plurality of speaker assemblies, each of the speaker assemblies including a speaker, an audio amplifier for amplifying sound to the speaker, the audio amplifier further including leads connected to the wiring cable for supplying electrical power to the audio amplifier, and a battery storage electrically connected to the wiring cable for storing electrical energy and for supplying the electrical energy to the audio amplifier.

16 Claims, 2 Drawing Sheets

LOW VOLTAGE SPEAKER AND LIGHTING SYSTEM

FIELD OF THE INVENTION

This invention relates to outdoor lighting and sound systems. More particularly, this invention relates to sound systems that may be employed in combination with low-voltage outdoor lighting systems.

DESCRIPTION OF THE BACKGROUND ART

Outdoor lighting for landscaping is well known. More particularly, in the outdoor lighting and landscaping arts, it is customary to illuminate and delineate pathways, driveways, sidewalks, patios, plant beds, and columns with lighting. Such lighting is typically used to provide illumination for practical as well as decorative purposes, including highlighting, landscaping and various architectural features of buildings.

Presently, there exist a variety of outdoor lighting devices that use a variety of embodiments and power sources. Typically, power sources employed comprise a low-voltage AC or DC voltage source that is provided to each of the individual outdoor lighting devices by means of wiring buried in or lying on the ground.

Conventional sound systems are also well known. Outdoor sound systems typically comprise a plurality of strategically located speakers connected by speaker wires to a stereo system. Typically, the speaker wires are run under the eaves of the house or other structure or are buried in the ground in such a manner that each outdoor speaker is electrically connected to the speaker output of the stereo system. Unfortunately, as can be appreciated, considerable wiring must be installed in order to properly wire the outdoor speakers. There therefore exists a need to integrate outdoor speaker systems with outdoor lighting systems so as to minimize the amount of wiring that is being installed.

Another object of this invention is to provide integrated outdoor lighting and sound systems that are powered by the low voltage wiring commonly used in connection with conventional outdoor lighting. Another option of this invention is to provide integrated outdoor lighting and sound systems wherein outdoor speakers may be conveniently installed alongside the conventional outdoor lighting devices.

The foregoing has outlined some of the pertinent objects of the invention. These objects should be construed to be merely illustrative of some of the more prominent features of the applications of the intended invention. Many other beneficial results can be attained by applying the disclosed invention in a different manner or modifying the invention within the scope of the disclosure. Accordingly, other objects and a fuller understanding of the invention can be attained by reviewing the detailed description of the preferred embodiment in addition to the scope of the invention defined by the claims taken in conjunction with the accompanying drawings.

SUMMARY OF THE INVENTION

For the purpose of summarizing this invention, this invention comprises an integrated outdoor lighting and sound system. More particularly, the outdoor lighting system of the invention comprises a plurality of outdoor lighting devices that are strategically located as desired throughout the landscape to be illuminated. Low voltage electrical power is provided to each of the outdoor lighting devices by means of a two-conductor wiring cable having one end connected to a conventional low-voltage transformer supplied by conventional household current. The wiring cable extends from the transformer to each of the outdoor lighting devices and is typically buried in the ground, run under sidewalks, along the eaves of the house, and the like.

The outdoor sound system of the invention comprises a plurality of speakers that are electrically connected to the wiring cable at desired locations throughout the landscaping. Each of the speaker assemblies comprises an audio speaker powered by an audio amplifier. The audio amplifier is supplied with electrical energy by means of a bank of rechargeable batteries that are charged by means of a charging circuit from the low voltage electrical energy from the wiring cable. The sound for the audio amplifier may be received by means of an AM/FM receiver, by an integrated audio source that produces nature sounds, or by a dedicated receiver that receives audio transmissions, electromagnetically via air transmission or via the wiring cable, from a master sound system located indoors. Importantly, each speaker assembly is self-contained and is capable of producing the selected sound (nature sounds, AM/FM broadcast or dedicated sounds from master sound system) without the need to install any additional wiring throughout the landscaping. Furthermore, due to the built-in charging system and rechargeable batteries, the speaker assemblies may operate at times when the outdoor lighting is not on, such as during daylight hours. Each night, the bank of rechargeable batteries is then simply recharged as the outdoor lighting turns on.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciate by those still in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

1.

Similar reference characters refer to similar parts throughout the several views of the drawings.

DETAILED DESCRIPTION OF THE PREFERRED EMBODIMENT

Figure 1:
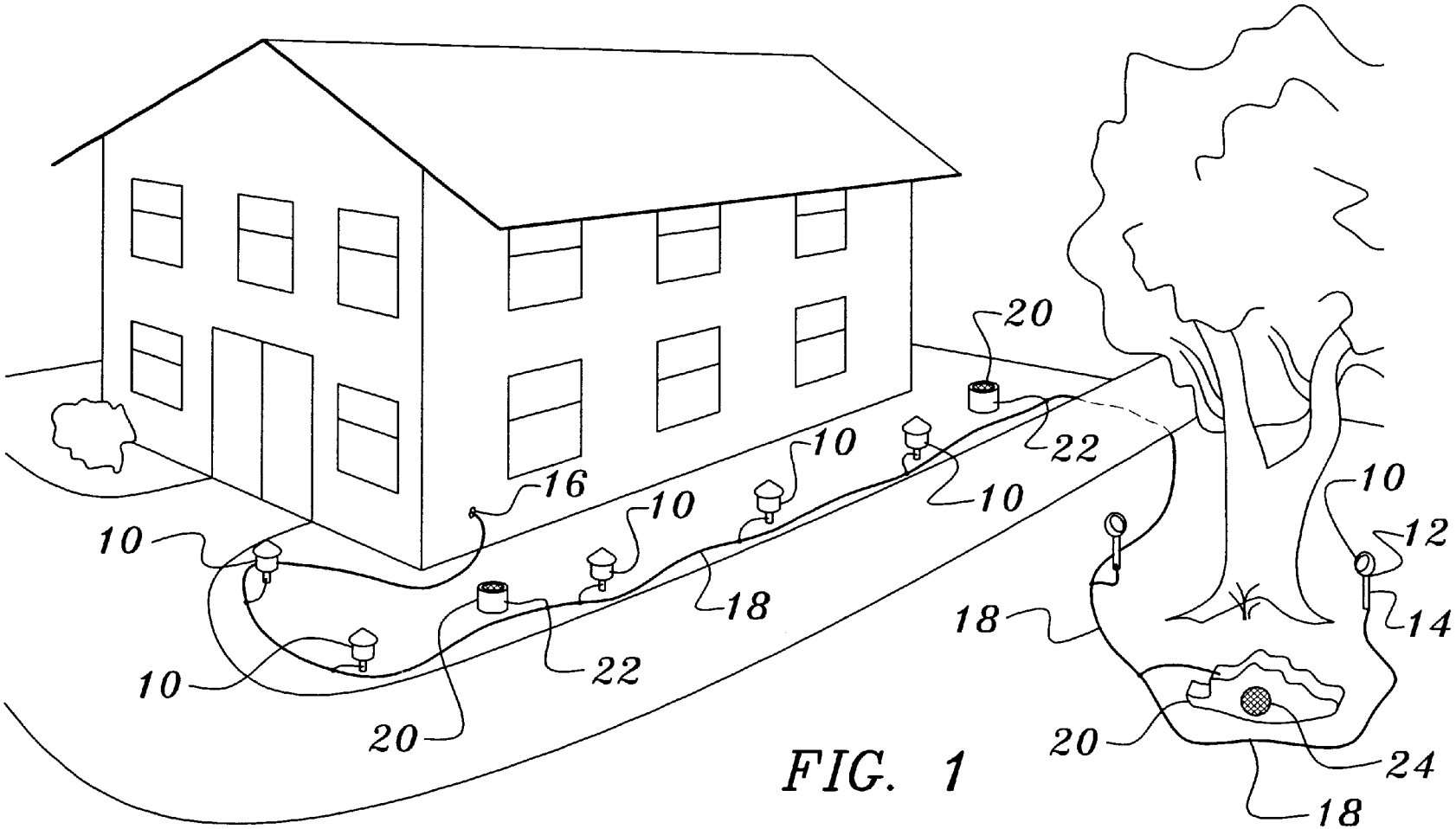
FIG. 1. is a diagrammatic view of the integrated outdoor lighting and sound system of the invention; and 2.

As shown in FIG. 1, a conventional outdoor lighting design for illuminating outdoor landscaping, typically comprises a light housing 10 containing a light source connected to the end of an elongated support 12. A spike shaped stake 14 is connected to the other end of the elongated support 12 allowing the outdoor lighting 10 to be staked into the ground around the landscaping that is desired to be illuminated. Outdoor lighting 10 may be powered by conventional AC or DC electrical current via a transformer 16 that is typically low-powered to reduce the hazards of inadvertent electrical shock. Typically, the electrical current is provided by means of a two-conductor wiring cable 18 that is buried alongside each of the lighting units 10. One end of the wiring cable 10 is connected to the low voltage transformer 16 that may be operatively controlled by means of a timer or light-sensing device, to turn on the lights 10 only during nighttime. Typically, the transformer 16 is powered by conventional household current.

Figure 2:
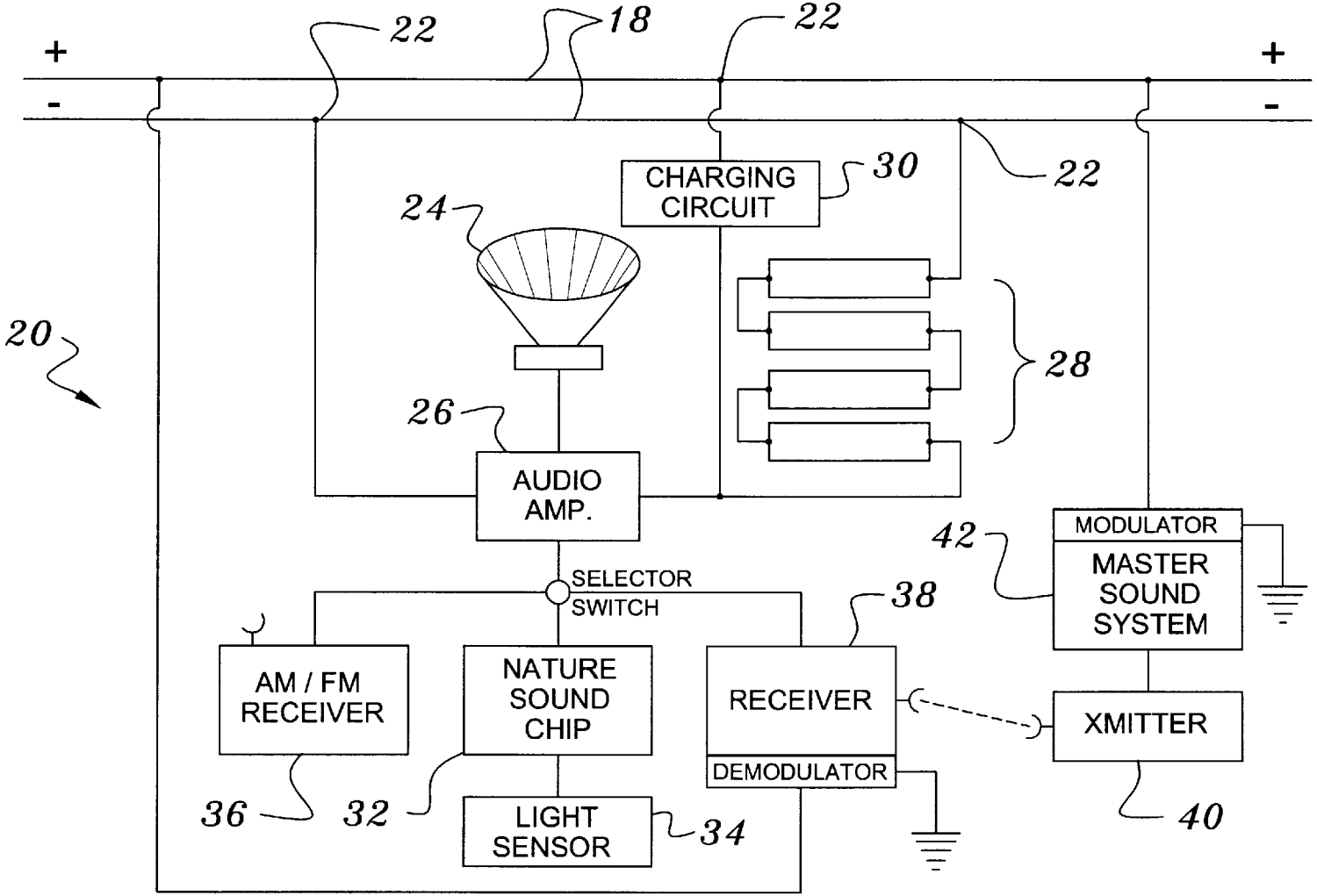
FIG. 2. is a schematic diagram of the speaker system of the invention which includes a bank of rechargeable batteries for powering an audio amplifier for the speaker during daylight hours when the outdoor lighting system would typically be turned off.

The speaker assemblies 20 of the invention may be positioned anywhere throughout the landscaping as desired and connected to the wiring cable 18 by means of a universal connector 22. As shown on the schematic diagram of FIG. 2., each of the speaker assemblies 20 comprises a conventional audio speaker 24 having its inputs connected and powered by an audio amplifier 26. Power to the audio amplifier 26 is provided by leads connected in parallel to the wiring cable 18 and/or by leads connected and parallel to a bank of rechargeable batteries 28. A charging circuit 30, connected to the wiring cable 18, is provided for charging the rechargeable batteries 29. It is noted that during nighttime periods when the landscaping lights 10 are on, the electrical power from the wiring cable 18 is sufficient to power audio amplifier 26 and charge the batteries 28. Conversely, during daylight hours when the landscaping lights 10 are typically off, the electrical power needed to power the audio amplifier 26 is provided by the bank of rechargeable batteries 28.

The audio input to the audio amplifier 26 may be connected to several sources. One source may comprise an integrated chip 32 that produces frequencies representative of sounds of nature selected by a daylight sensor 34. Another source may comprise a conventional AM/FM receiver 36. Still another source may comprise a receiver 38 that receives electromagnetic transmissions from a corresponding transmitter 40 connected to a conventional indoor master sound system 42 so as to allow the playing of music from CDs, and other media to each of the speaker assemblies 20. The electromagnetic transmissions may be transmitted atmospherically through the air or via the wiring cable 18 (e.g., a modulated carrier wave).

It should be appreciated that the speaker assemblies 20 of the invention may be conveniently installed without any additional wiring. Specifically, the speaker assemblies 20 of the invention may be sold "after-market" to be used in connection with conventional lighting systems. Indeed, the speaker assemblies 20 may be used with already-installed lightning systems without having to install any additional wiring cables 18. Furthermore, all or groups of the speaker assemblies 20 may be controlled by the master sound system 42 to assure that the same audio is being played from all, or the desired groups, of speaker assemblies 20. Therefore, there is significant improvement and advancement over prior art sound systems that are not integrated with conventional lighting systems.

Present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts made be resorted to without departing from the spirit and scope of the invention.

Now that the invention has been described,

What is claimed is:

1. An integrated outdoor lighting and sound systems comprising in combination:

a plurality of low-voltage AC or DC-powered outdoor landscaping lighting units;

a wiring cable comprising two-conductors interconnecting said plurality of low-voltage AC or DC-powered outdoor landscaping lighting units;

a source of low-voltage AC or DC electrical energy connected to said two-conductors of said wiring cable for supplying AC or DC voltage to said low-voltage AC or DC-powered outdoor landscaping lighting units; and a plurality of speaker assemblies, each of said speaker assemblies including a speaker, an audio amplifier for amplifying sound to said speaker, said audio amplifier having two leads respectively electrically connected to said two-conductors of said wiring cable, and a battery storage means having two leads respectively electrically connected to said two-conductors of said wiring cable for storing said AC or DC energy therefrom when said source of low voltage AC or DC energy is supplied to said two conductors of said wiring cable to power said low-voltage AC or DC-powered outdoor landscaping lighting units, and for supplying stored electrical energy to said audio amplifier when said AC or DC energy is not being supplied to said low-voltage AC or DC-powered outdoor landscaping lighting units.

2. The integrated outdoor lighting and sound system as set forth in claim 1, further including means for charging said battery storage means.

3. The integrated outdoor lighting and sound systems as set forth in claim 1, further including a source of sound supplied to an audio input of said audio amplifier.

4. The integrated outdoor lighting and sound system as set forth in claim 3, wherein said audio source comprises one of a group including nature sounds, AM/FM sounds or sounds received eletromagnetically from a transmitter.

5. The integrated outdoor lightning and sound system as set forth in claim 1, wherein said source of low-voltage AC or DC energy comprises a low-voltage transformer that supplies low-voltage AC or DC energy to said two conductors of said wiring cable.

6. A speaker assembly for connection to a low-voltage wiring cable comprising two conductors of a low-voltage AC or DC-powered outdoor landscaping lighting system having a plurality of low-voltage AC or DC-powered outdoor landscaping lighting units, for use in connection therewith, the speaker assembly comprising in combination:

a speaker, an audio amplifier for amplifying sound to said speaker, said audio amplifier having two leads electrically respectively connected to said two conductors of said wiring cable, and a battery storage means having two leads respectively electrically connected to said two conductors of said wiring cable for storing said AC or DC energy therefrom when said source of low voltage AC or DC energy is supplied to said two conductors of said wiring cable to power said low-voltage AC or DC-powered outdoor landscaping lighting system, and for supplying stored AC or DC electrical energy to said audio amplifier when said AC or DC energy is not being supplied to said low-voltage AC or DC-powered outdoor landscaping lighting units.

7. The speaker assembly as set forth in claim 6, further including means for charging said battery storage means with low-voltage AC or DC energy from said two conductor wiring.

8. The speaker assembly as set forth in claim 6, further including a source of sound supplied to an audio input of said audio amplifier.

9. The speaker assembly as set forth in claim 8, wherein said audio source comprises one of a group including nature sounds, AM/FM sounds or sounds received eletromagnetically from a transmitter.

10. The speaker assembly as set forth in claim 6, wherein said source of low-voltage AC or DC energy comprises a low-voltage transformer that supplies low-voltage AC or DC energy to said two conductor wiring cable.

11. A sound system composed of a plurality of speaker assemblies as set forth in claim 6.

12. The sound system as set forth in claim 11, wherein said sound is supplied to an audio input of said audio amplifier of each of said speaker assemblies.

13. The sound system as set forth in claim 12, wherein said sound is received electromagnetically from a transmitter.

14. The sound system as set forth in claim 13, wherein said sound received eletromagnetically from said transmitter comprises sounds received from a transmitter connected to a master sound system.

15. The sound system as set forth in claim 14, wherein said sound received from said transmitter are transmitted atmospherically.

16. The sound system as set forth in claim 14, wherein said sound received from said transmitter are transmitted via said two conductors of said wiring cable.

* * * * *